United States Patent [19]

Finley

[11] Patent Number: 4,867,452

[45] Date of Patent: Sep. 19, 1989

[54] VISUALLY ENHANCED FOOTBALL

[76] Inventor: Charles O. Finley, 155 N. Michigan Ave., Chicago, Ill. 60601

[21] Appl. No.: 359,140

[22] Filed: May 31, 1989

[51] Int. Cl.[4] ..... A63B 41/08; A63B 43/06

[52] U.S. Cl. ..... 273/65 E; 273/65 EF; 40/327

[58] Field of Search ..... 273/65 E, 65 EC, 65 ED, 273/65 EE, 65 EF, 65 EG, 63 C, 61 R; 40/327; D21/204, 205

[56] References Cited

U.S. PATENT DOCUMENTS

| | | | |
|---|---|---|---|
| 235,794 | 7/1875 | Kroener | D21/205 |
| D. 264,741 | 6/1982 | Patton | D21/205 |
| D. 285,230 | 8/1986 | Adams | D21/204 |
| 2,011,760 | 8/1935 | Gallinant | 273/65 |
| 2,143,340 | 1/1939 | Denkert | 273/65 |
| 3,318,598 | 5/1967 | Ruskin | 273/63 |
| 3,370,851 | 2/1968 | Murray | 273/65 |
| 3,904,201 | 9/1975 | Henry | 273/61 R |
| 4,345,759 | 8/1982 | Nims | 273/65 R |
| 4,546,975 | 10/1985 | Nims | 273/65 R |
| 4,772,020 | 9/1988 | Martin | 273/65 EE |

FOREIGN PATENT DOCUMENTS

| | | | |
|---|---|---|---|
| 854595 | 11/1960 | United Kingdom | 273/61 R |

OTHER PUBLICATIONS

"The Sporting Goods Dealer", Oct. 1973, p. 41, Relief on Copy available in 273-65EE.

The Sporting Goods Dealer, Feb. 1974, p. 61, Relief on.

*Primary Examiner*—George J. Marlo

*Attorney, Agent, or Firm*—Neuman, Williams, Anderson & Olson

[57] ABSTRACT

The longitudinal extent of a football is circumscribed with contrasting indicia so that upon rotation of the ball about substantially the longitudinal axis, a first visually distinctive image is produced. When the ball rotates about substantially a transverse axis, a second visually distinctive image is produced. The indicia is of such form that it does not protrude substantially from the surface of the ball and does not adversely affect the normal flight and gripping of the ball.

8 Claims, 1 Drawing Sheet

VISUALLY ENHANCED FOOTBALL

BACKGROUND OF THE INVENTION

1. Field of the Invention

The present invention relates to prolate spheroidal sports balls, particularly footballs, and more particularly to enhancing the visibility of such balls during play.

2. Background of the Invention

Applicant Charles O. Finley is a widely regarded sports figure who has introduced pioneering advancements, including visual enhancements, to professional sports. As the former owner of the Oakland Athletics baseball club, applicant made substantial contributions to the game of baseball, including the introduction of the designated hitter rule and the playing of World Series and All-Star games at night. Applicant also introduced colorful uniforms and white shoes to the game of baseball to replace the prison gray uniforms and black shoes previously worn by players. Applicant's sports interests have also extended beyond the game of baseball, applicant having owned a professional hockey club, the California Golden Seals, and a professional basketball club, the Memphis Tams, while simultaneously pursuing his professional baseball interests.

In the late 1960s, as the owner of the Oakland Athletics baseball club, applicant introduced the visually enhanced "Alert Orange Baseball" to the game of baseball. The Alert Orange Baseball had two principal advantages over conventional white baseballs: (1) fans could follow the flight of an orange ball more easily than a white ball, and (2) batters could see an orange ball being delivered by a pitcher more easily than a white ball. In exhibition games, fans reacted overwhelmingly positively to the Alert Orange Baseball. Umpires also attested to the benefits of the Alert Orange Baseball, stating that the ball was not only easier to see from behind the plate, but gave rise to a greater number of hits and fewer fielding errors in exhibition games in which the orange baseball was used.

In various sports, such as football, the visibility of the ball during play can also make a marked improvement in the performance of the participating players and added enjoyment to spectators and television viewers observing the game. This is especially true in football where games are normally played out-of-doors and sometimes in inclement weather (e.g., rain, snow, fog, or mist). Visibility of the ball is just as important however on bright sunny days when difficulty might be encountered in distinguishing the ball from the surrounding background of the stands and/or playing field. It is therefore desirable to provide a football that is readily visible under both circumstances.

The prolate spheroidal shape of a football provides for two distinct modes of spin: spiral and end-over-end. When thrown, the football usually spins in spiral fashion about its principal or longitudinal axis, assuming a bullet-like appearance. When punted, the ball may either rotate in a spiral about its longitudinal axis or rotate end-over-end about a transverse axis. When place-kicked from a tee or upwardly held position, the ball generally rotates end-over-end. It would be to the advantage of the offensive receiver or the defensive player to be able to more readily distinguish the moving ball from the surrounding background and to also more readily discern the particular rotational mode of the ball. For this reason and also to enable spectators and television viewers to more closely follow the flight of the ball, it is desirable to provide the ball with enhanced visibility in such a way that it will not adversely affect the flight of the ball.

Prior football designs have included orienting indicia. For example, Murray U.S. Pat. No. 3,370,851 is directed to a football having indica visible to a punter for orienting the ball relative to his kicking foot. However, the Murray design only assists the player from whom the ball originates to orient the ball; it does not enhance the visibility of the ball to receivers and spectators.

Prior football designs have also included longitudinal elements. For example, Gallinant U.S. Pat. No. 2,011,760 is directed an anti-skid attachment for game balls and describes a sheath or harness which is to be applied to the ball for enhancing the player's grip on the ball. While some of the modifications of the Gallinant design include sheaths having longitudinal elements, the purpose of the sheaths is grip enhancement, not visual enhancement. In addition, the Gallinant sheath adds weight, thereby altering the normal flight of the ball. Moreover, the sheath protrudes from the surface of the ball, creating added wind resistance and turbulence that would alter the trajectory of the ball when thrown, punted or kicked.

OBJECTS OF THE INVENTION

An object of the invention is to provide a visually enhanced sports ball that is readily distinguishable from the surrounding background to both players, spectators and television viewers.

A further object of the invention is to provide a visually enhanced sports ball that enables the axis of rotation of the ball to be readily discerned during flight.

A still further object of the invention is to provide a visually enhanced sports ball suitable for use under artificial light or in climatic situations wherein visibility is poor.

Other objects, advantages and features of the invention will become apparent upon reading the following detailed description and appended claims, and upon reference to the accompanying drawings.

SUMMARY OF THE INVENTION

These and other objects are achieved by a sports ball, such as a football, having a visually enhancing design applied to the exterior surface of the ball. The design extends in a direction substantially parallel to a principal or longitudinal axis of the ball such that a distinctive visual image is produced as the ball while in flight rotates about the said principal axis. The applied design produces a second distinctive image when the ball while in flight rotates about a transverse axis. In the preferred embodiment, the applied design includes at least one stripe which substantially circumscribes the ball's exterior.

BRIEF DESCRIPTION OF THE DRAWINGS

For a more complete understanding of the invention, reference should now be made to the embodiments illustrated in greater detail in the accompanying drawings and described below by way of example only. In the drawings.

DETAILED DESCRIPTION OF THE PREFERRED EMBODIMENT

Figure 1:
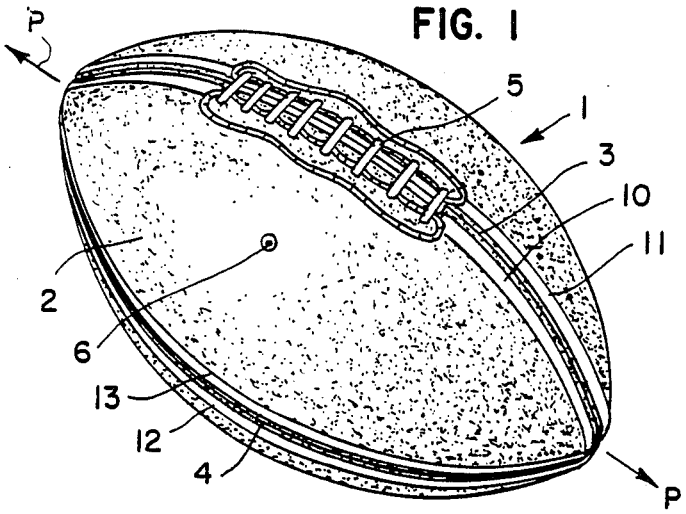
FIG. 1 is a perspective view of one embodiment of the improved visually enhanced sports ball.
Figure 2:
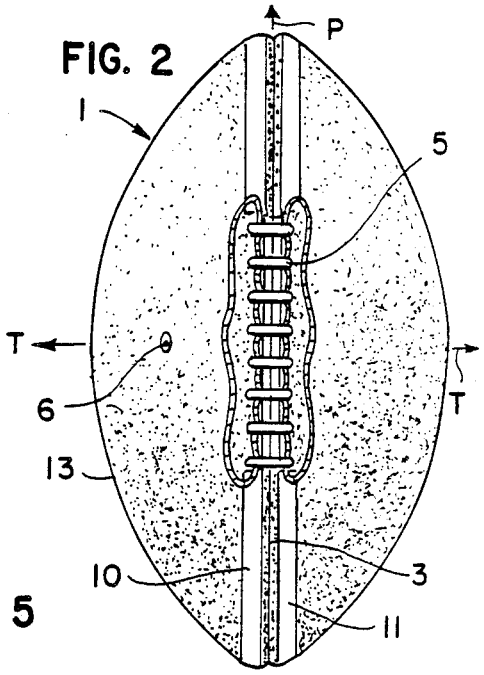
FIG. 2 is a top plan view of FIG. 1.
Figure 3:
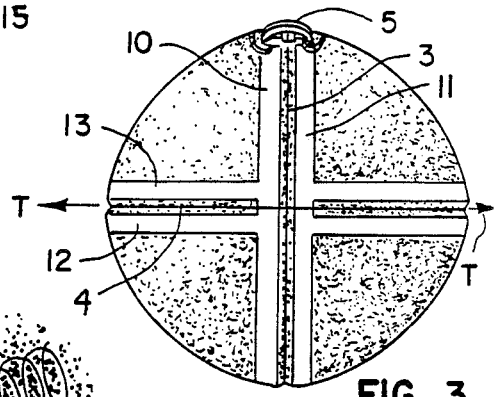
FIG. 3 is an end elevation of FIG. 1.

Turning now to FIGS. 1–3, a sports ball such as a football 1 of conventional prolate spheroidal configuration is shown which may comprise an inflated rubber bladder (not shown) enclosed in a leather or synthetic leather-like cover 2 normally formed of four panels joined at longitudinal seams 3 and 4. The longitudinal direction is defined herein as being parallel to principal or longitudinal axis P—P of ball 1, see FIGS. 1 and 2. The bladder is inserted through a gap in seam 3 and secured by laces 5, which are typically of a contrasting color to the leather of cover 2. Ball 1 is inflated by the introduction of air through a valve 6. In some instances where the cover is formed of a synthetic impervious leather-like material, the bladder may be omitted and the four panels may be integral with one another and defined by longitudinally extending scorelines, and the laces may be embossed on the cover in alignment with a selected scoreline.

In the embodiment illustrated in FIGS. 1–3, indicia in the form of two pairs of stripes 10, 11 and 12, 13 are applied to the cover exterior. Stripes 10, 11 extend along either side of seam 3 from one end of laces 5 longitudinally around the unlaced portion of the ball to the other end of the laces. Thus, stripes, 10, 11 and laces 5 form a design that longitudinally circumscribes the football. Similarly, stripes 12, 13 extend along either side of seam 4 to form a design that longitudinally circumscribes the football. Stripes 10, 11 and 12, 13 may be white, yellow, fluorescent or some other visually contrasting color, and are usually either painted on the ball cover, or by suitable tape, decals or other indicia means attached to the cover exterior. Fluorescent white is the preferred color for television viewing. In any form, the indicia do not adversely affect the normal flight of the football nor do they impede the grasp of the player when either throwing, punting or catching the ball.

As shown in FIGS. 1–3, the stripes 10, 11 and 12, 13 are disposed in substantial alignment with the principal axis P—P of ball 1 so that when the ball is thrown or punted in spiral fashion with rotation about axis P—P, the stripes rotate transversely to their length and create a blurred image which appears to cover the entire ball. In this way the entire football appears as a spinning projectile having the color of the stripes. Thus, the visibility of the ball is markedly improved to players on the field, the spectators in the stands as well as the television viewers.

When ball 1 is kicked or punted in an end-over-end fashion about a transverse axis T—T as shown in FIGS. 1–3, a distinctly different visual image is created from that when the ball rotates about axis P—P. When the ball is rotated about transverse axis T—T, the visually enhanced exterior area will be localized, stripes 10, 11 forming a visually enhanced central portion and producing an image of a single stripe or a pair of stripes running the length of the ball. Similarly, stripes 12, 13 will visually enhance the perimeter and silhouette the ball when the ball is rotated about transverse axis T—T. In this manner, receivers, spectators and television viewers can readily distinguish between spiral and end-over-end punts or passes, thereby enabling the receiver to take whatever compensating physical moves are necessary to execute the play properly. The markings will also enable the player originating the pass, kick or punt to assess the effectiveness and accuracy of the pass, kick or punt. The visually enhanced ball can therefore be profitably used as a practice aid for passers, punters and place kickers.

Figure 4:
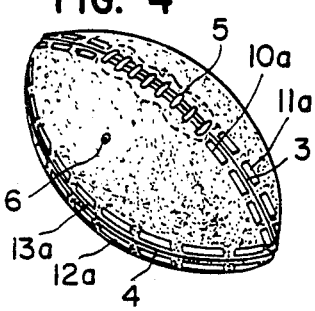
FIG. 4 is a perspective view of a second embodiment of the improved sports ball.

The stripes on the visually enhanced football need not be continuous and/or completely circumscribe the ball. FIG. 4 for example, shows stripes 10*a*, 11*a* and 12*a*, 13*a* formed of spaced longitudinally aligned segments or markings. These individual segments coact to function in a manner similar to that of continuous stripes 10, 11 and 12, 13 of FIGS. 1–3.

Figure 5:
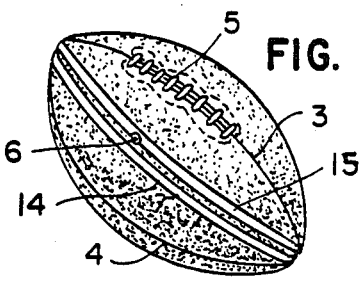
FIG. 5 is a perspective view of a third embodiment of the improved sports ball.

FIG. 5 shows an embodiment wherein the stripes 14, 15 do not extend along seams 3 and 4, but instead may be located between the seams 3 and 4, if desired.

Figure 6:
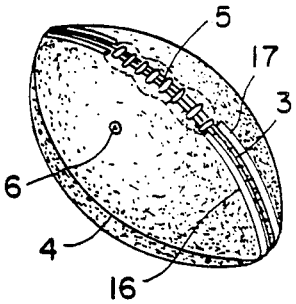
FIG. 6 is a perspective view of a fourth embodiment of the improved sports ball.

FIG. 6 shows an embodiment wherein one pair of stripes 16, 17 circumscribes the ball along longitudinal seam 3. In this embodiment, a ball thrown or punted in spiral fashion about its principal axis would be visually enhanced, but to a lesser degree than football 1 in FIGS. 1–3, due to the omission of one pair of contrasting stripes. Once again, however, the characteristic pattern assumed when the ball is kicked or punted end-over-end would be distinguishable from that produced when the ball follows a spiral trajectory.

Figure 7:
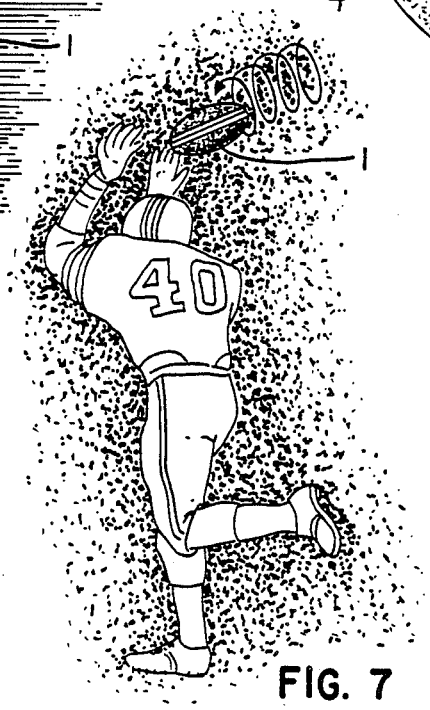
FIG. 7 is a schematic view of the sports ball of FIG. 1 in play under adverse climatic conditions such as fog.

In FIG. 7, football 1 is illustrated in a spiral trajectory to a receiver during play when the visibility is impaired due to adverse climatic conditions (e.g., rain, fog, snow, mist, etc.). The stripes will enhance the visibility of the ball under such conditions, and consequently should improve the proficiency and performance of the receivers and the view and enjoyment of spectators and television viewers.

Figure 8:
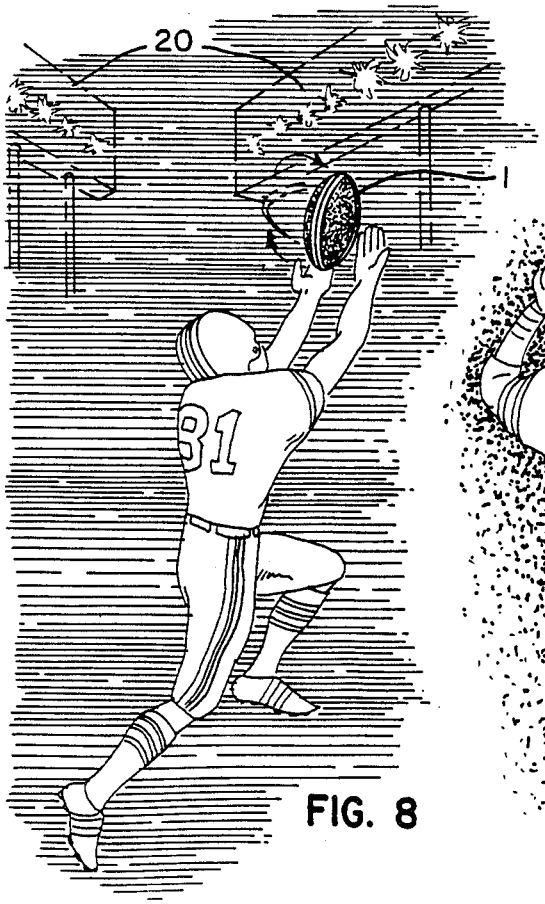
FIG. 8 is a schematic view of FIG. 1 of the sports ball in play under artificial lights.

Similarly, FIG. 8 illustrates football 1 travelling in end-over-end fashion to a receiver under conditions wherein the playing field is illuminated by floodlights 20. The enhanced visibility of football 1 enables the receiver to follow the path of the ball against a background of alternating darkness and floodlights.

From the foregoing it will be apparent that a football is provided that is visually enhanced to improve the performance of players on the field and the enjoyment of spectators and television viewers in following the execution of various plays. Moreover, the visually enhanced football enables the axis of rotation of the ball to be readily distinguished during flight and thus enable the receiver, as well as the defender, to make whatever physical move that is necessary to complete the play. The visually enhanced football also provides an effective aid to the punter and the place-kicker to properly position the ball before the foot of the punter or place-kicker strikes the ball.

While several embodiments of the visually enhanced sports ball have been disclosed herein, additional longitudinally oriented markings or indicia may be applied to a prolate spheroidal sports ball without departing from the spirit and scope of the invention.

What is claimed is:

1. A visually enhanced prolate spheroidal football having a longitudinal axis and a transverse axis, said ball comprising an exterior surface having means defining the appearance of indicia which generally circumscribes the longitudinal extent of the football so that upon rotation of the ball about the longitudinal axis a first distinctive visual image is produced and upon rotation about a transverse axis a second distinctive visual image is produced, said means being of a form such that it does not protrude substantially from the surface of the ball and does not adversely affect the normal flight and gripping of the ball.

2. The football of claim 1 wherein said means includes at least one stripe which substantially circumscribes said longitudinal extent.

3. The football of claim 2 wherein said means is substantially continuous.

4. The football of claim 1 wherein said means includes a plurality of spaced, longitudinally aligned segments.

5. The football of claim 1 wherein said means at least partially circumscribes the ball.

6. The football of claim 1 wherein said means includes a pair of substantially parallel stripes.

7. The football of claim 1 wherein said means includes a plurality of stripes.

8. The football of claim 1 wherein said means and the remainder of the exterior surface have contrasting colors.

* * * * *